US008692635B2

(12) United States Patent
Slotte

(10) Patent No.: US 8,692,635 B2
(45) Date of Patent: Apr. 8, 2014

(54) SOUND GENERATING APPARATUS

(75) Inventor: Thomas Benedict Slotte, Turku (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 13/449,707

(22) Filed: Apr. 18, 2012

(65) Prior Publication Data

US 2013/0278364 A1 Oct. 24, 2013

(51) Int. Cl.
*H01F 7/08* (2006.01)

(52) U.S. Cl.
USPC ..... 335/220; 381/396

(58) Field of Classification Search
USPC ..... 335/302–306, 220–223; 381/401, 402, 381/396; 340/7.6, 388.1–388.8
See application file for complete search history.

(56) References Cited

U.S. PATENT DOCUMENTS

| | | | | |
|---|---|---|---|---|
| 4,608,463 | A | 8/1986 | Burgess et al. | 179/115.5 |
| 6,243,472 | B1 | 6/2001 | Bilan et al. | 381/117 |
| 6,370,257 | B1 * | 4/2002 | Bleim et al. | 381/409 |
| 7,162,050 | B2 * | 1/2007 | Furuya et al. | 381/351 |
| 7,277,555 | B2 * | 10/2007 | Klein et al. | 381/409 |
| 7,567,680 | B2 | 7/2009 | Murray et al. | 381/181 |
| 7,869,617 | B2 * | 1/2011 | Jang et al. | 381/396 |
| 8,022,799 | B2 * | 9/2011 | Ueda et al. | 335/222 |
| 2002/0168074 | A1 * | 11/2002 | Miyamoto et al. | 381/182 |
| 2004/0071303 | A1 | 4/2004 | Furuya et al. | 381/182 |
| 2004/0086146 | A1 | 5/2004 | Kato et al. | 381/412 |
| 2007/0060221 | A1 | 3/2007 | Burgan et al. | 455/575.7 |

* cited by examiner

*Primary Examiner* — Bernard Rojas
(74) *Attorney, Agent, or Firm* — Harrington & Smith

(57) ABSTRACT

An apparatus including an electromagnetic coil and a magnet system. The electromagnetic coil includes electrical leads. The magnet system forms electrical conductors connected to the electrical leads of the coil. The magnet system is configured to provide an electrical interface.

28 Claims, 9 Drawing Sheets

SOUND GENERATING APPARATUS

BACKGROUND

1. Technical Field

The exemplary and non-limiting embodiments relate generally to a magnet system for use with an electromagnetic coil and, more particularly, to an electrical connection provided by the magnet system.

2. Brief Description of Prior Developments

A loudspeaker generally has a magnet, a coil and a diaphragm. The coil is electrically connected by wires or contacts to another member.

SUMMARY

The following summary is merely intended to be exemplary. The summary is not intended to limit the scope of the claims.

In accordance with one aspect, an apparatus is provided including an electromagnetic coil and a magnet system. The electromagnetic coil includes electrical leads. The magnet system forms electrical conductors connected to the electrical leads of the coil. The magnet system is configured to provide an electrical interface.

In accordance with another aspect, a method comprises providing a magnet system comprising at least one magnet and at least two pole pieces connected to a non-different pole of the at least one magnet; and connecting electrical leads from an electromagnetic coil to respective ones of the pole pieces. The respective ones of the pole pieces are electrically isolated from each other to provide separate electrical conductors to the electrical leads of the coil.

In accordance with another aspect, a method comprises sending current to an electromagnetic coil through a first pole piece of a magnet system; and sending the current from the coil through a second pole piece of the magnet system.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
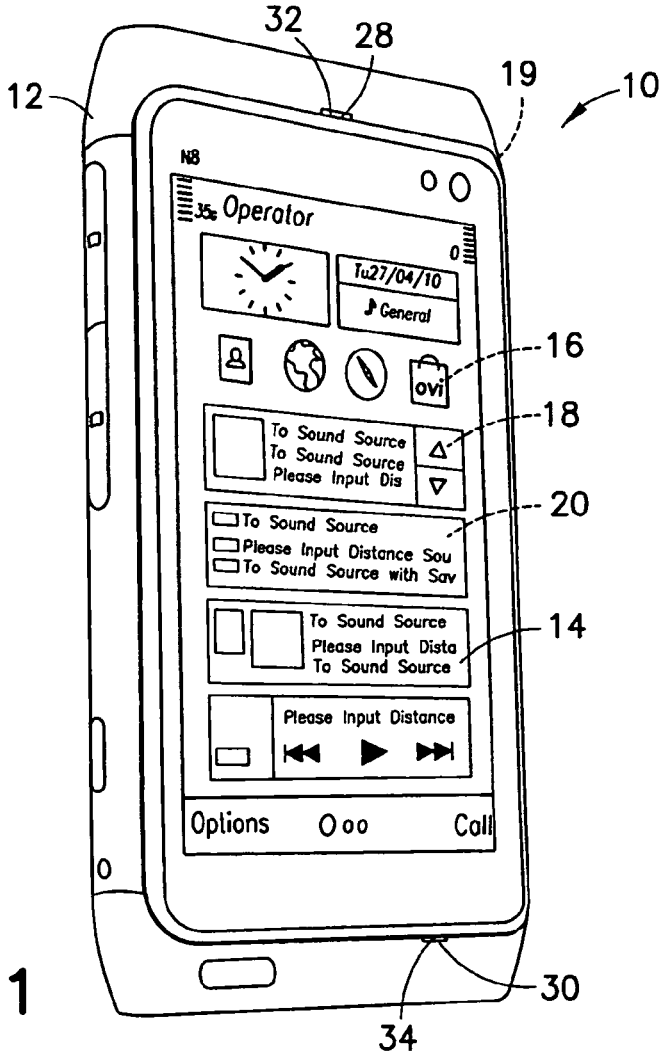
FIG. 1 is a perspective view of an example embodiment.

Referring to FIG. 1, there is shown a perspective view of an apparatus 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

Figure 2:
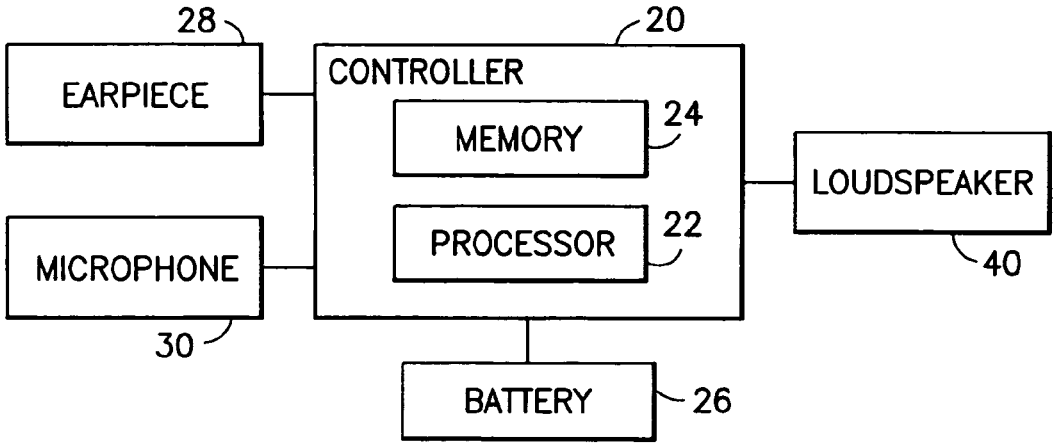
FIG. 2 is a diagram illustrating some of the components of the apparatus shown in FIG. 1.

The apparatus 10 in this example is a hand-held portable electronic device comprising a telephone application, Internet browser application, camera application, video recorder application, music player and recorder application, email application, navigation application, gaming application, and/or any other suitable electronic device application. The apparatus 10, in this example embodiment, comprises a housing 12, a touch screen 14 which functions as both a display and a user input, a receiver 16, a transmitter 18, a controller 20 which can include (referring also to FIG. 2) at least one processor 22, at least one memory 24 with software, and a rechargeable battery 26. However, these features are not necessary to implement the protection described below. For example, a touch screen or additionally a conventional keypad or other user input could be used. Thus, features could be used in any suitable type of device, such as a telephone only for example.

Figure 3:
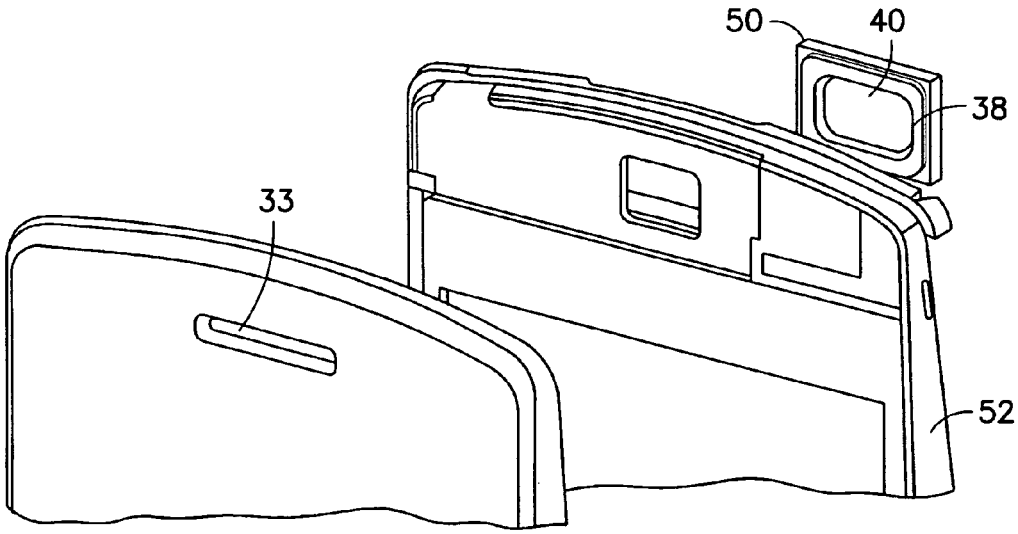
FIG. 3 is a partial exploded perspective view of components of the apparatus shown in FIG. 1.

The apparatus 10 also includes a speaker or earpiece 28 and a microphone 30 which each comprise a sound transducer. Referring also to FIG. 3, the apparatus 10 also includes a loudspeaker 40. The housing 12 comprises at least one sound hole 32 for sound to travel from the speaker 28, at least one sound hole 34 for sound to travel to the microphone, and at least one sound hole 33 for sound to travel from the loudspeaker 40. The description which follows will be in regard to the area at the loudspeaker 40. However, the features described are equally applicable to other coil/magnet assemblies. Features of the invention could be used at the speaker 28 for example.

Figure 4:
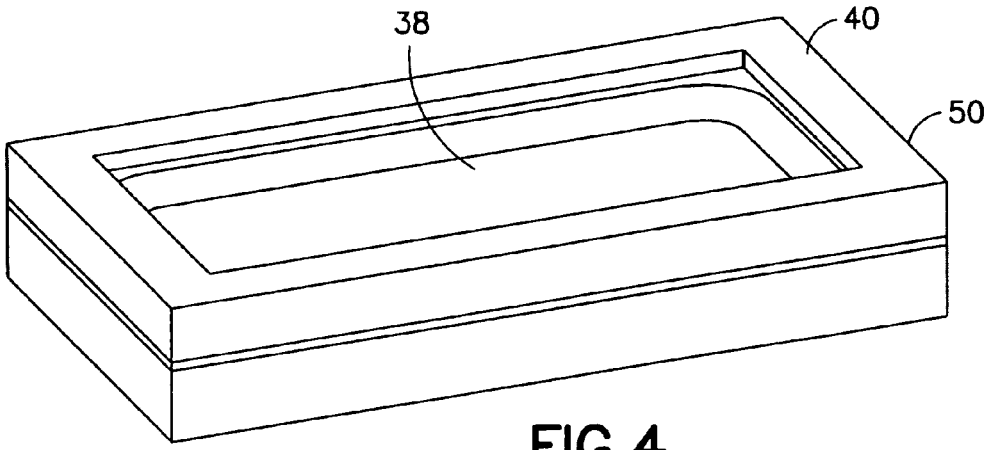
FIG. 4 is a perspective view of a top side of the loudspeaker shown in FIG. 3.
Figure 5:
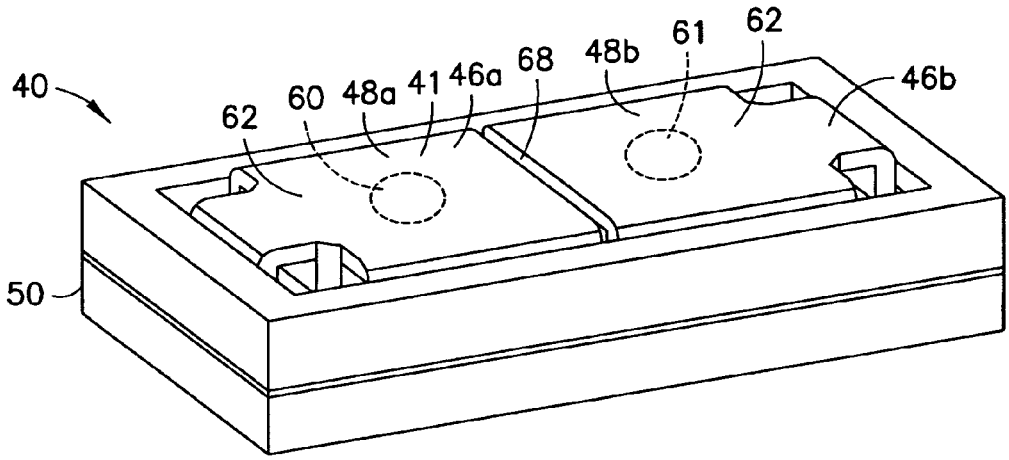
FIG. 5 is a perspective view of the loudspeaker shown in FIG. 4 from an opposite bottom side.
Figure 6:
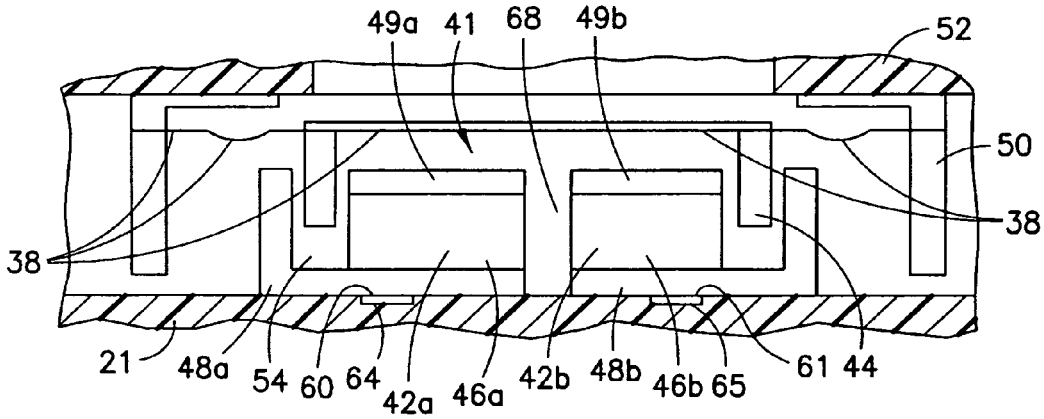
FIG. 6 is a schematic cross sectional view of a portion of the apparatus shown in FIG. 1.

Referring also to FIGS. 4-6, the loudspeaker 40 is a sound transducer. The sound transducer includes a magnet system 41, a coil 44, and a diaphragm 38 connected to the coil 44. The magnet system 41 comprises two permanent magnets 42*a*, 42*b* and four pole pieces 48*a*, 48*b*, 49*a*, 49*b*. In an alternate embodiment the magnets could be an electromagnet. In the example shown in the drawings the magnet system 41 is comprised of two magnet subsystems 46*a*, 46*b*. The first magnet subsystem 46*a* comprises the first permanent magnet 42*a* and the first pole pieces 48*a*, 49*a*. The second magnet subsystem 46*b* comprises the second permanent magnet 42*b* and the second pole pieces 48*b*, 49*b*. The magnets 42*a*, 42*b* have their poles aligned in the same directions to essentially function as a larger single permanent magnet. In an alternate example more than four pole pieces could be provided. In the example shown the diaphragm 38 has its outer perimeter connected to a housing 50 which can be mounted to a back-side of a frame piece 52 (see FIG. 3). The magnets 42 and pole pieces 48, 49 form an area 54 for the coil 44 to move in.

The two magnet subsystems 46*a*, 46*b* are spaced from each other by a gap 68. The two magnet subsystems 46*a*, 46*b* are not directly connected to each other. Instead, the two magnet subsystems 46*a*, 46*b* are each connected to the printed wiring board (PWB) 21. Thus, the PWB 21 indirectly connects the two magnet subsystems 46*a*, 46*b* to each other. In an alternate embodiment, any suitable connection of the magnet subsystems 46*a*, 46*b* to each other could be provided so long as two isolated electrical conductor paths are provided. For example, the housing 50 can provide this function.

A pole piece is a structure composed of material of high magnetic permeability that serves to direct the magnetic field produced by a magnet. A pole piece attaches to and, in a sense, extends a pole of the magnet, hence the name. Magnetic flux will travel along the path that offers it the least amount of resistance, (or, more accurately, the least amount of reluctance). Steel components in a magnetic circuit offer the flux a low reluctance path. This fact allows the use of steel pole pieces to capture flux and concentrate it, (or merely redirect it), to the point of interest.

Focusing of flux can be achieved by tapering the steel. However, one must be aware that as the pole area of the steel pole piece decreases, the flux density within the steel (B) will increase (if the total flux traveling through the steel component remains constant). Steel pole pieces can also be used to homogenize the field over the active volume.

Pole pieces are needed because magnets are hard to make into complex shapes which may be needed and, thus, expensive. Pole pieces are used with both permanent magnets and electromagnets. In the case of an electromagnet, the pole piece or pieces simply extend the magnetic core and can even be regarded as part of it, particularly if they are made of the same material. The traditional material for pole pieces was soft iron. While still often used with permanent magnets, soft iron suffers from eddy currents which make it less suitable for use with electromagnets, and particularly inefficient when the magnet is excited by alternating current. Pole pieces take many shapes and forms depending on the application. A traditional dynamic loudspeaker has a distinctive annular magnet and pole piece structure which serves to concentrate the magnetic flux on the voice coil. The central, cylindrical pole piece surrounded by the voice coil is normally referred to as the pole piece. A second pole piece in turn surrounds the voice coil.

For the loudspeaker 40, when the electrical current flowing through the voice coil 44 changes direction, the coil's polar orientation reverses. This changes the magnetic forces between the voice coil and the permanent magnet/pole pieces, moving the coil and attached diaphragm back and forth.

The electromagnet is positioned in a constant magnetic field created by the permanent magnets 42 and the pole pieces 48, 49. The electromagnet and the permanent magnets interact with each other as any two magnets do. The positive end of the electromagnet is attracted to the negative pole of the permanent magnetic fields, and the negative pole of the electromagnet is repelled by the permanent magnets' negative poles. When the electromagnet's polar orientation switches, so does the direction of repulsion and attraction. In this way, the alternating current constantly reverses the magnetic forces between the voice coil and the permanent magnets. This pushes the coil back and forth rapidly, like a piston.

When the coil moves, it pushes and pulls on the diaphragm 38. This vibrates the air in front of the diaphragm, creating sound waves. The electrical audio signal can also be interpreted as a wave. The frequency and amplitude of this wave, which represents the original sound wave, dictates the rate and distance that the voice coil moves. This, in turn, determines the frequency and amplitude of the sound waves produced by the diaphragm.

Figure 7:
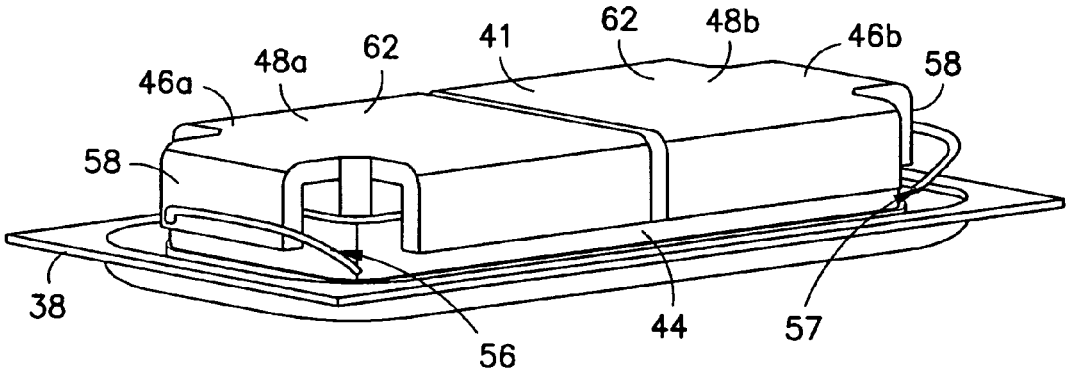
FIG. 7 is a perspective view of the loudspeaker shown in FIGS. 3-5 without the housing.
Figure 8:
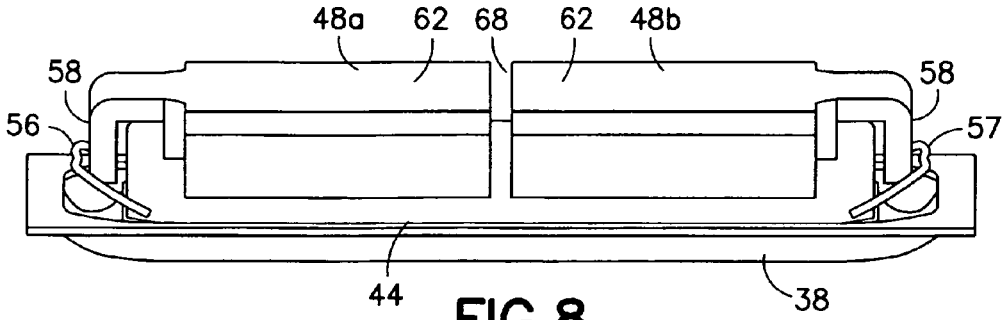
FIG. 8 is a side view of the loudspeaker as shown in FIG. 7.
Figure 9:
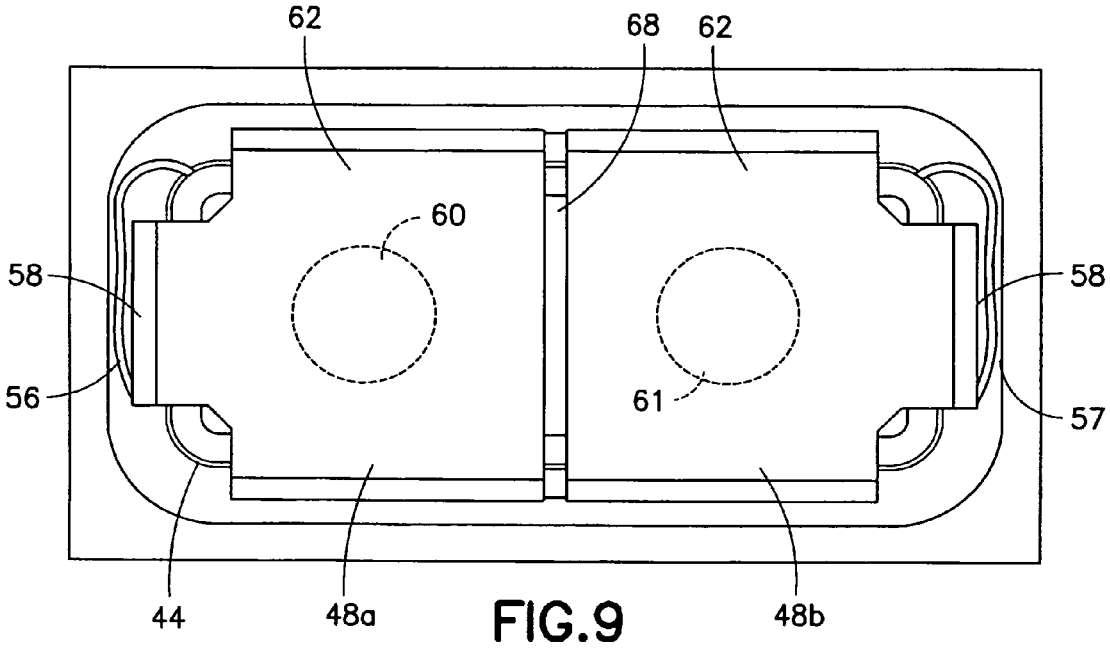
FIG. 9 is a bottom view of the loudspeaker shown in FIGS. 7-8.

Referring also to FIGS. 7-9, the loudspeaker 40 is shown without the housing 50. Opposite ends 56, 57 of at least one wire which forms the coil 44 extend outward from the coil and are electrically connected to portions of the pole pieces 48*a*, 48*b*. The ends 56, 57 form electrical leads for the coil 44. In an alternate example any suitable type of connection between the pole pieces and the coil could be provided. The length and shape of the leads 56, 57 allows the coil 44 to move relative to the pole pieces without the leads breaking. In other words, the leads 56, 57 form flexible electrical connections between the coil and the pole pieces.

Figure 10:
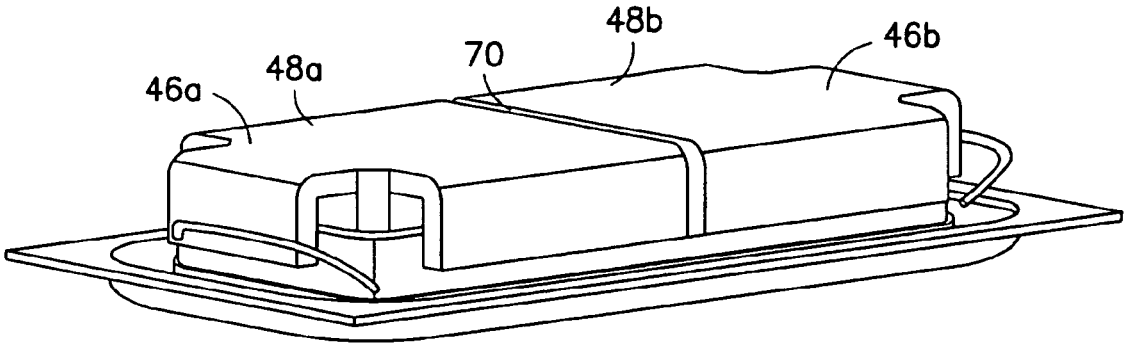
FIG. 10 is a view similar to FIG. 7 showing an alternate example embodiment.

The leads 56, 57 could be soldered to the portions 58 or slip fit connected, such as loops on the portions 58 for example. Any suitable connection could be provided. The pole pieces 48*a*, 48*b* form the sole electrical connection to the coil 44. Thus, the pole pieces 48*a*, 48*b* function as both pole pieces for the magnets 42*a*, 42*b* and as electrical terminals for the coil 44. An air gap 68 is provide between the two pole pieces 48*a*, 48*b* to maintain their electrical isolation from each other. In an alternate example, such as shown in FIG. 10, an electrical insulation material 70 may be provide in the gap 68. This electrical insulation material 70 can also function to mechanically connect the two magnet subassemblies 46*a*, 46*b* as a unitary magnet assembly before connection to the PWB 21.

As seen in FIGS. 5 and 9, the outward facing sides 62 of the pole pieces 48*a*, 48*b* form contact areas or pads 60, 61 for connection to another member. Thus, the sides 62 and areas 60, 61 form an electrical interface for mechanical and electrical connection to another member. Referring back to FIG. 6, in this example the outward facing sides 62 of the pole pieces 48*a*, 48*b* are located directly against a printed wiring board (PWB) 21 of the controller 20. The contact areas 60, 61 are electrically connected directly to contact pads 64, 65 of the PWB 21. Current can be supplied from pad 64 to contact area 60, through first pole piece 48*a*, to first coil lead 56, through the coil 44, and return back to the PWB through 57, 48*b*, 61 and 65.

Features described above may also be used in an electrodynamic loudspeaker which does not use a permanent magnet. Features described above may be most beneficial in loudspeakers used in small size-constrained devices, where also cost is a primary concern.

The shrinking size of loudspeakers creates various challenges. The highest possible performance is needed from the smallest possible loudspeaker size. This means that one must continuously consider ways of simplifying and miniaturizing the mechanics of loudspeakers, without impacting performance. Another equally important area of optimization is performance versus price.

The electrical connection to a loudspeaker is usually handled by two contact springs pressing against corresponding pads on the printed wiring board (PWB) under the loudspeaker. Another common method is to provide soldering pads, to which wires can be soldered. These springs, or pads, are then internally electrically connected to the voice coil of the loudspeaker (e.g. by welding). The voice coil is situated in a strong permanent magnetic field, and provides the force that drives the loudspeaker diaphragm, thus generating sound. In most small loudspeakers, a single magnet is used. A minority of loudspeakers uses two or more magnets.

Features described above may have a magnet system (magnets plus pole pieces) which are effectively split into two parts, such as two halves for example, that are electrically isolated from each other. These two separate parts do double duty as magnet systems and as electrical contact points. It is, therefore, possible to get rid of the conventional separate contact springs or pads, which saves cost and space.

The split of the magnet system is made in such a way that the magnetic field in the air gap 54 (where the voice coil 44 is located) is reduced as little as possible. Both ends 56, 57 of the voice coil wire are connected to suitable points on the respective magnet subsystems 46*a*, 46*b*. The bottom parts 62 of the magnet subsystems 46*a*, 46*b* now provide electrical contact pads 60, 61 for the loudspeaker. Alternatively, parts of the magnet assemblies can be left exposed also on the sides of the loudspeaker, providing contact pads there.

With features of an example embodiment described above, the magnet system may be divided into at least two parts that are electrically isolated from each other, and the split is made in such a way that portions of at least two pole pieces can be used as electrical terminals and contact points for the wires from the coil.

It should be noted that in alternate embodiments the split can be oriented in some different way than shown in the drawings. Furthermore, the gap between the magnet system parts does not have to be empty, but it may as well be filled with material 70 such as, for example, glue, or generally any material that is electrically nonconductive, or at least has a high electrical resistance.

It should also be noted that the small width of the split 68 has only a very small or negligible effect on the performance of the loudspeaker. The split(s) between conductive parts of the magnet system may be designed so as to impair the performance of a nearby antenna as little as possible. In other words, the exact dimensions of the various mutually isolated parts could be chosen to achieve a certain desired response to an external RF field.

Advantages can include

- Considerably simpler mechanical construction of loudspeaker itself (no separate contact springs or pads)
- Lower cost of loudspeaker itself (whether the total cost is also lower will depend on the chosen connection method)
- Potentially smaller loudspeaker size for a given performance
- Potentially higher thermal power handling capacity (depends on other construction details, not necessarily directly related to the invention)
- Higher reliability (fewer parts and simpler construction leads to a generally lower risk of failure).
- Potential advantage for antenna integration (smaller contiguous volume of conductive material, therefore potentially impacting the performance of nearby antennas less than a conventionally constructed loudspeaker of the same size).

In one type of example, the entire magnet system can be effectively split into two parts that are electrically isolated from each other. This allows pole pieces attached to the magnet systems to be used as the two electrical terminals. The coil wires can be welded (or otherwise mechanically and electrically attached) to the pole pieces. Further variations are possible. The magnet system halves could, for example, include protruding soldering pads on the sides of the loudspeaker, etc.

Thermal conduction from the voice coil 44 to the surrounding mechanics can be improved by good design. The voice coil is connected to the magnet system subsystems 46*a*, 46*b*; which are more efficient heat sinks than conventional contact springs would be. This is especially true if more uncommon solutions such as a spider of a loudspeaker is used, since this will provide potentially very efficient thermal conduction from the voice coil to the magnet subsystems 46*a*, 46*b*.

Figure 11:
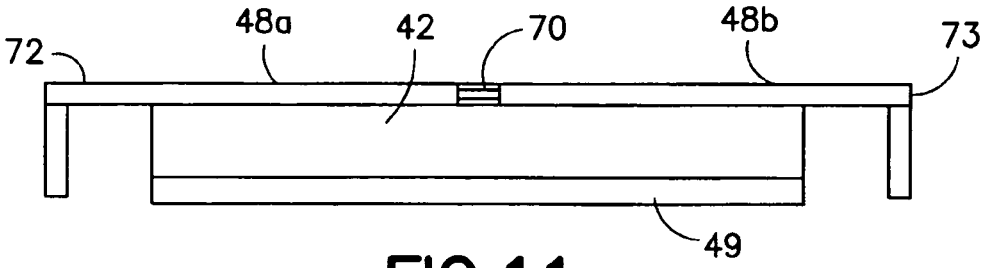
FIG. 11 is a schematic side view of another alternate embodiment.

In an alternate example embodiment, a single permanent magnet could be used in the magnet system 41 if the pole pieces 48*a*, 48*b* are kept electrically isolated from each other in the magnet system. An example of this is shown in FIG. 11. The magnet system could comprises one permanent magnet 42 and three pole pieces 48*a*, 48*b*, 49. In this example, the magnet system still forms two magnet subsystems with pole pieces 48*a*, 48*b* electrically isolated from each other, but where each magnet subsystem comprises a portion of the same single magnet 42. In the example shown the two parts or subsystems 72, 73 each form one half of the magnet system with electrical insulator 70 at least partially mechanically connecting the two parts. As another alternative, 48 and 42*a* could be formed as a single magnet rather than a pole piece connected to a magnet. Likewise, 49 and 42*b* could be formed as a single magnet rather than a pole piece connected to a magnet. The electrical insulation 70 should not impair the magnetic circuit(s) too much. In other words, the insulating layer can have a high permeability in spite of being electrically nonconductive.

Figure 11A:
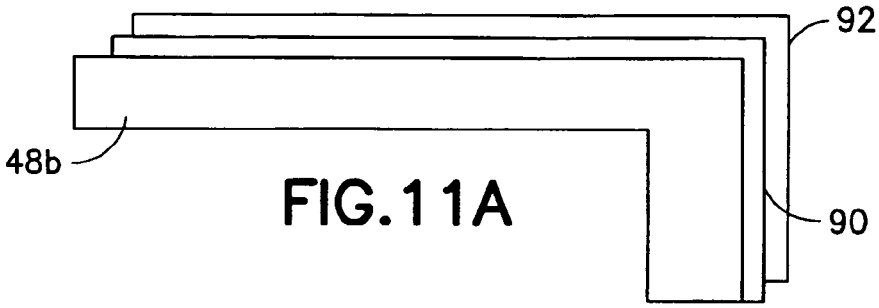
FIG. 11A is a side view of another alternate embodiment.
Figure 11B:
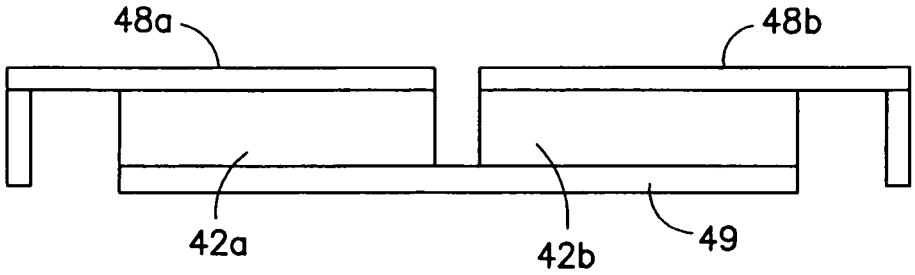
FIG. 11B is a side view of another alternate embodiment.

FIG. 11B shows another example where the magnet system comprises two permanent magnets 42*a*, 42*b* and three pole pieces 48*a*, 48*b* and 49. The pole piece 49 keeps the two magnets 42*a*, 42*b* mechanically connected to each other in a unitary assembly, but still can allow the pole pieces 48*a*, 48*b* to not be directly electrically connected to each other.

In most conventional loudspeakers, there is one magnet and two pole pieces. In a minority of loudspeakers, there can be more, such as 3 magnets and 4 pole pieces, or perhaps even 5 magnets and 6 pole pieces. However, these still form one single electrically conductive block. Neodymium-based magnets are typically used in at least some mobile phone loudspeakers.

Features as described herein differ from a typical loudspeaker in that the magnet system is no longer one single electrically conductive block. Instead, two (or more) subsystems are provided that are electrically isolated from one another. What this means is that the most common kind of magnet system, consisting of 1 magnet and 2 pole pieces, would effectively become 2 magnets and 4 pole pieces when split into two halves.

Figure 11C:
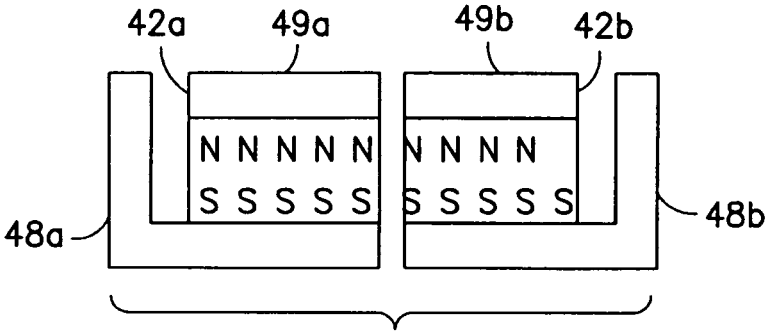
FIG. 11C is a diagram illustrating the magnetic poles of the magnets of the example shown in FIG. 6.
Figure 11D:
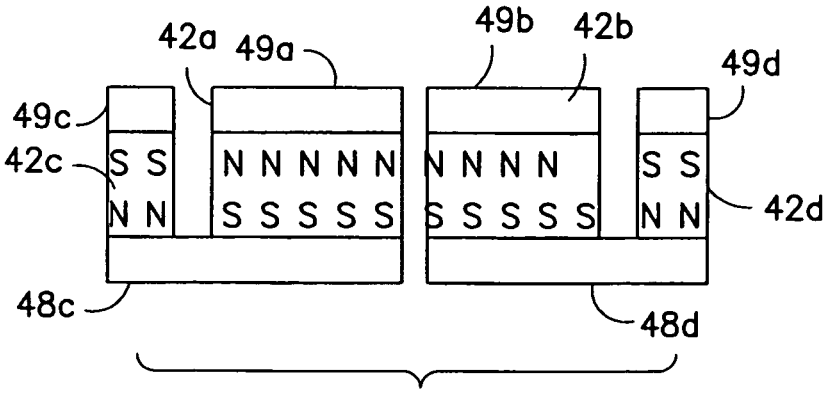
FIG. 11D is a diagram similar to FIG. 11C showing another example.

Referring also to FIG. 11C, the N and S poles of the magnets 42*a*, 42*b* for the example shown in FIG. 6 is shown. N and S can of course also be swapped in a different example. FIG. 11D shows another example with more magnets and pole pieces.

One type of example apparatus, 40 or 10 for example, could comprise an electromagnetic coil 44, where the coil comprises opposite electrical leads 56, 57; and a magnet system forming electrical conductors 48*a*, 48*b* connected to the electrical leads of the coil, where the magnet system is configured to electrically connect the coil to another member 21.

The electrical leads could comprise opposite ends of an electrical wire forming the coil. The electrical leads could comprise conductors connecting opposite electrical ends of the coil to the magnet system. The magnet system could comprises at least one permanent magnet and at least two pole pieces connected to a non-different pole of the at least one permanent magnet. For example, with a single permanent magnet the non-different pole could be a N pole, and for an embodiment with two magnets the non-different pole could be a N pole of both permanent magnets. The at least one permanent magnet could comprise a single permanent magnet. Referring also to FIG. 11*a*, at least one pole piece 49 could have an electrical conductor 92 on it, such as a trace, isolated from the main material of the pole piece by an insulator 92, where the conductor 92 (which is part of the magnet system and integral on the pole piece 49) provides the electrical connection of the coil to the other member. In this type of situation, the magnet system might only have one pole piece. The at least one permanent magnet could comprises a first permanent magnet assembled with a first one of the pole pieces as a first subassembly 72, and a second permanent magnet assembled with a second one of the pole pieces as a second subassembly 73, where the first and second subassemblies are connected together to form the magnet system. The magnet system could comprise a first pole piece and a second pole piece, where the first and second pole pieces are electrically isolated from each other, and where the first and second pole pieces are configured to electrically connect opposite electrical ends of the coil to the another member. The first and second pole pieces could each comprise an electrical contact pad 60, 61 adapted to electrically connect the magnet system to the another member. The apparatus 40 could further comprise a diaphragm 38 mechanically connected to the coil. The apparatus could be a hand held electronic device comprising a printed wiring board 21, and wherein the magnet system comprises at least two pole pieces electrically connected to contact pads 64, 65 of the printed wiring board.

Figure 12:
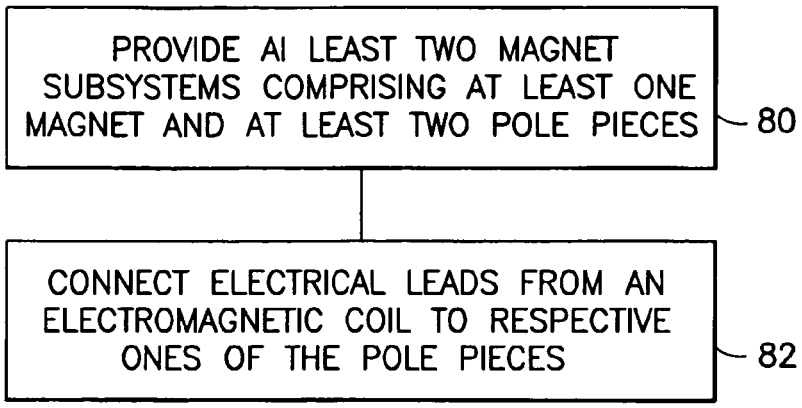
FIG. 12 is a diagram illustrating an example method.

Referring also to FIG. 12, one example method comprises providing a magnet system comprising at least two magnet subsystems with at least one magnet and at least two pole pieces connected to a non-different pole of the at least one magnet as indicated by block 80; and connecting electrical leads from an electromagnetic coil to respective ones of the pole pieces as indicated by block 82, where the respective ones of the pole pieces are electrically isolated from each other to provide separate electrical conductors to the electrical leads of the coil.

A pole piece is usually a slab of material attached to a pole of the magnet. The purpose of the pole piece is to act as a kind of "conductor" for the magnetic field. So in one example embodiment, each of the halves of the magnet system would have two pole pieces (one on either pole of the respective magnet). So there would be four pole pieces all in all. In one example embodiment, where the magnet system is split into more than two mutually isolated magnet parts, the pole pieces of only two of the magnet parts might be used for the electrical connection. More and smaller parts potentially interfere less with RF antennas. In another example embodiment the transducer could comprise two voice coils and two magnets, with two diaphragms located on opposite sides of the assembly. In another example embodiment the transducer could comprise two voice coils, two diaphragms and a single magnet.

Providing the magnet system can comprise the at least one magnet being a single permanent magnet. Providing the magnet system can comprise the at least one magnet being two separate permanent magnets, and connecting a first one of the pole pieces to a first pole of a first one of the permanent magnets, and connecting a second one of the pole pieces to a first pole of a second one of the permanent magnets. Connecting the electrical leads can comprise connecting a first end of a wire forming the coil directly to a first one of the pole pieces, and connecting an opposite second end of the wire forming the coil directly to a second one of the pole pieces. The method could further comprise electrically connecting an electrical contact pad on each of the pole pieces directly to electrical contact pads of another member. The method could further comprise filling a gap between opposing ends of the pole pieces with electrically non-conductive material.

Another example method comprises sending current to an electromagnetic coil through a first pole piece of a magnet system; and sending the current from the coil through a second pole piece of the magnet system.

In one example, one of the pole pieces is split, and both of these pole piece halves are attached to the same pole of a same magnet. In such a case one or both of the pole pieces has to be isolated electrically, but not magnetically, from the magnet, otherwise the coils will be short-circuited. This is possible, but requires proper material (i.e. electrically nonconductive but having a high magnetic permeability) between pole piece(s) and magnet.

Figure 13:
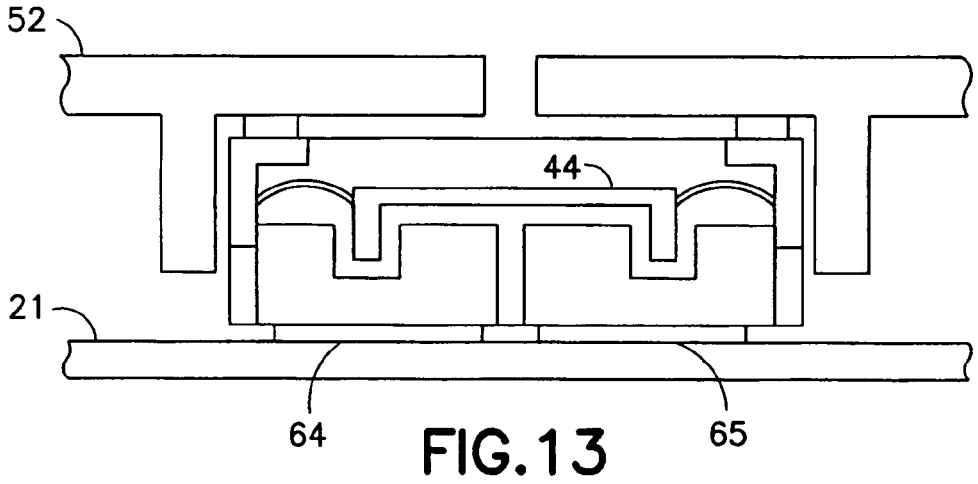
FIG. 13 is a diagram illustrating another example embodiment.
Figure 14:
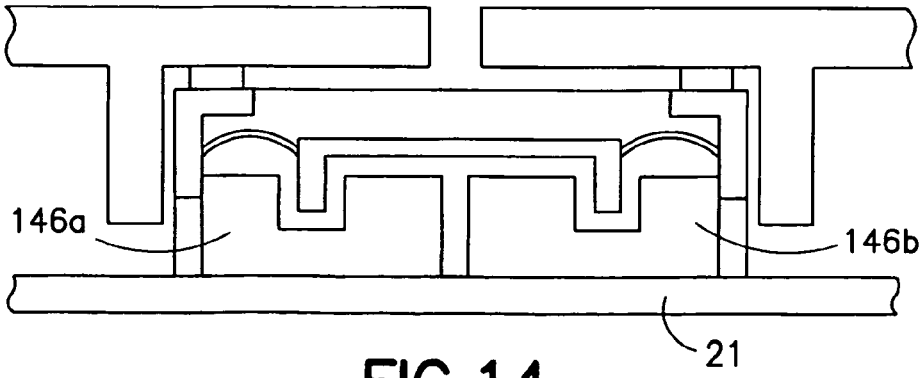
FIG. 14 is a diagram illustrating another example embodiment.
Figure 15:
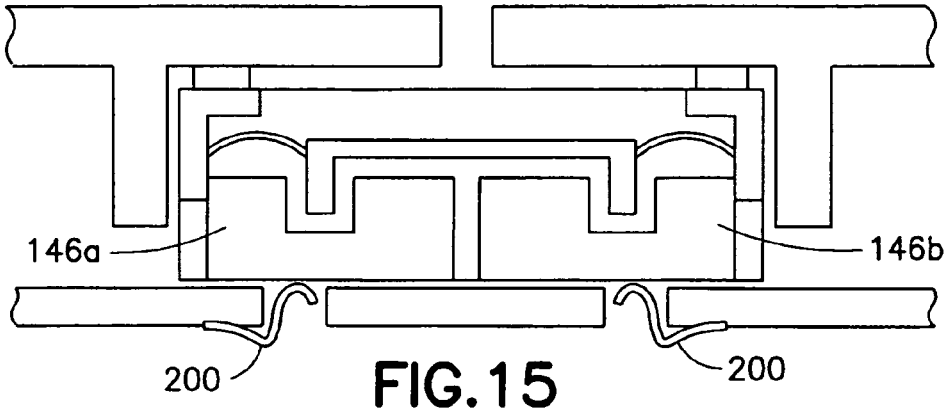
FIG. 15 is a diagram illustrating another example embodiment.
Figure 16:
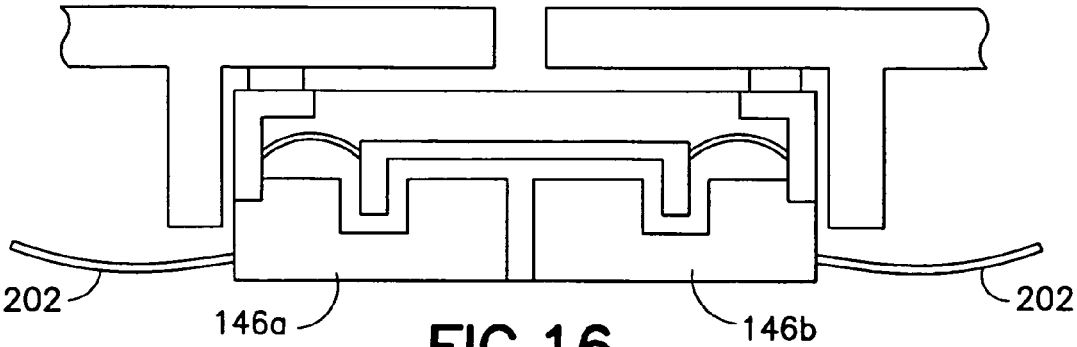
FIG. 16 is a diagram illustrating another example embodiment.

Referring also to FIG. 13, in one example embodiment there are no contact springs between the coil 44 and the printed wiring board 21, and the magnet system halves are acting as electrical contacts (resting on some additional pads 64, 65 on the PWB 21). Referring also to FIG. 14, in one example embodiment the magnet system halves 146*a*, 146*b* are in direct contact with the PCB 21. Referring also to FIG. 15, in one example embodiment external springs 200 are making the electrical contact to the magnet system halves 146*a*, 146*b*. Referring also to FIG. 16, in one example embodiment wires 202 are soldered/welded to pads formed by the magnet system halves 146*a*, 146*b*.

With an example embodiment having features described herein, the electrical connection between the coil and the magnet system can provide a heat transfer path such that the magnet system provides a heat sink for the coil. A portable electronic device 10 could be provided comprising the apparatus as described above and an antenna 19 (see FIG. 1) located proximate the apparatus 40, where a split (or splits) between conductive parts of the magnet system are configured not to substantially impair performance of the antenna to achieve a predetermined desired response to an external RF field.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising:

a coil, where the coil comprises electrical leads; and a magnet system forming at least one electrical conductor connected to at least one of the electrical leads of the coil, where the magnet system is configured to provide an electrical interface, where the magnet system comprises a first pole piece and a second pole piece, where the first and second pole pieces are electrically isolated from each other, and where the first and second pole pieces are configured to electrically connect the electrical leads of the coil to another member.

2. An apparatus as in claim 1 where the electrical leads comprise opposite ends of an electrical wire forming the coil.

3. An apparatus as in claim 1 where the electrical leads comprise conductors connecting opposite electrical ends of an electrical wire forming the coil to the magnet system.

4. An apparatus as in claim 1 where the magnet system comprises at least one permanent magnet and at least the first and second pole pieces connected to a non-different pole of the at least one permanent magnet.

5. An apparatus as in claim 4 where the at least one permanent magnet comprises a single permanent magnet.

6. An apparatus as in claim 4 where the least one permanent magnet comprises a first permanent magnet assembled with the first pole piece as a first magnet subassembly, and a second permanent magnet assembled with the second pole piece as a second magnet subassembly, where the first and second magnet subassemblies are connected together to form the magnet system.

7. An apparatus as in claim 4 further comprising electrical insulation between the first and second pole pieces, where the electrical insulation is electrically nonconductive and comprises a high permeability.

8. An apparatus as in claim 1 where the first and second pole pieces each comprise an electrical contact area adapted to electrically connect the magnet system to the another member.

9. An apparatus as in claim 1 further comprising a diaphragm mechanically connected to the coil.

10. An apparatus as in claim 9 where the apparatus is a hand held electronic device comprising a printed wiring board, and wherein the magnet system comprises at least the first and second pole pieces electrically connected to contact pads of the printed wiring board.

11. An apparatus as in claim 1 comprising means, on at least one of the pole pieces of the magnet system, for electrically connecting the coil to the another member.

12. An apparatus as in claim 1 where an electrical connection between the coil and the magnet system provides a heat transfer path such that the magnet system provides a heat sink for the coil.

13. A portable electronic device comprising:

the apparatus as claimed in claim 1; and an antenna located proximate the apparatus, where a split between conductive parts of the magnet system are configured not to substantially impair performance of the antenna to achieve a predetermined desired response to an external RF field.

14. A method comprising:

providing a magnet system comprising at least one magnet and at least two pole pieces connected to the at least one magnet; and connecting at least one electrical lead from a coil to at least one of the pole pieces, where at least two of the pole pieces are electrically isolated from each other such that the at least one pole piece provides at least one separate electrical conductor for the at least one electrical lead of the coil.

15. A method as in claim 14 where providing the magnet system comprises the at least one magnet being a single permanent magnet.

16. A method as in claim 14 where providing the magnet system comprises the at least one magnet being two separate permanent magnets, and connecting a first one of the pole pieces to a first pole of a first one of the permanent magnets, and connecting a second one of the pole pieces to a first pole of a second one of the permanent magnets.

17. A method as in claim 14 where connecting the at least one electrical lead comprises connecting a first end of a wire forming the coil directly to a first one of the pole pieces, and connecting an opposite second end of the wire forming the coil directly to a second one of the pole pieces.

18. A method as in claim 17 further comprising electrically connecting an electrical contact area on each of the pole pieces directly to electrical contact pads of another member.

19. A method as in claim 14 further comprising filling a gap between opposing ends of the pole pieces with electrically non-conductive material.

20. A method comprising:

sending current to a coil through a first pole piece of a magnet system; and sending the current from the coil through a second pole piece of the magnet system, where the first and second pole pieces are spaced from each other such that the first and second poles piece provide separate electrical conductor leads respectively to and from the coil.

21. An apparatus as in claim 5 further comprising an electrical insulator which at least partially electrically insulates the first and second pole pieces from each other.

22. An apparatus as in claim 21 where the electrical insulator is located, at least partially, between the first pole piece and the single permanent magnet.

23. An apparatus as in claim 1 where the magnet system comprises at least one permanent magnet and at least the first and second pole pieces connected to the at least one permanent magnet, and the apparatus further comprises an electrical insulator which at least partially electrically insulates at least one of the pole pieces from the at least one permanent magnet.

24. An apparatus comprising:

a coil, where the coil comprises electrical leads;

a magnet system comprising a first permanent magnet and two pole pieces connected to the first permanent magnet, where at least one of the pole pieces forms an electrical conductor connected to at least one of the electrical leads of the coil; and an electrical insulator at least partially between the first permanent magnet and at least one of the pole pieces.

25. A method as in claim 15 where providing the magnet system comprises at least partially electrically insulating the single permanent magnet from at least one of the pole pieces to electrically isolate the pole pieces from each other.

26. A method as in claim 14 where providing the magnet system comprises providing an electrical insulator at least partially between a first magnet of the at least one magnet and at least one of the pole pieces.

27. A method as in claim 26 where providing the electrical insulator comprises providing the electrical insulator directly between two of the pole pieces.

28. A method as in claim 14 where providing the magnet system comprises the at least two pole pieces being connected to a non-different pole of the at least one magnet.

* * * * *